US009815597B2

(12) United States Patent
Ben-Arie

(10) Patent No.: US 9,815,597 B2
(45) Date of Patent: Nov. 14, 2017

(54) TWIST BASED DISPENSER

(71) Applicant: Jezekiel Ben-Arie, Chicago, IL (US)

(72) Inventor: Jezekiel Ben-Arie, Chicago, IL (US)

( * ) Notice: Subject to any disclaimer, the term of this patent is extended or adjusted under 35 U.S.C. 154(b) by 0 days.

(21) Appl. No.: 14/280,647

(22) Filed: May 18, 2014

(65) Prior Publication Data

US 2014/0339257 A1 Nov. 20, 2014

Related U.S. Application Data

(60) Provisional application No. 61/825,114, filed on May 20, 2013.

(51) Int. Cl.

| | |
|---|---|
| ***B65D 35/28*** | (2006.01) |
| ***B65D 35/46*** | (2006.01) |
| ***B65D 83/00*** | (2006.01) |

(52) U.S. Cl.

CPC ..... *B65D 35/28* (2013.01); *B65D 35/46* (2013.01); *B65D 83/0066* (2013.01)

(58) Field of Classification Search

CPC ... A47G 19/183; B65D 83/0066; B65D 35/28
USPC ..... 222/104, 386.5, 390, 92, 95
See application file for complete search history.

(56) References Cited

U.S. PATENT DOCUMENTS

| | | | | | |
|---|---|---|---|---|---|
| 1,491,860 | A | * | 4/1924 | Holden | 222/104 |
| 1,631,931 | A | * | 6/1927 | Geake | 222/104 |
| 2,234,857 | A | * | 3/1941 | Thorn et al. | 222/104 |
| 2,502,918 | A | * | 4/1950 | Beresford | 222/104 |
| 2,721,676 | A | * | 10/1955 | Andrews | B65D 83/0066 222/104 |
| 3,407,968 | A | * | 10/1968 | Fiquet et al. | 222/104 |
| 3,593,885 | A | * | 7/1971 | Wiggins et al. | 222/104 |
| 3,870,198 | A | * | 3/1975 | Cohen | B65D 83/0066 222/104 |
| 4,020,972 | A | | 5/1977 | Szczepanski | |
| 4,020,975 | A | * | 5/1977 | Stauffer | A47K 5/1211 222/105 |
| 4,159,790 | A | | 7/1979 | Bailey | |
| 4,351,336 | A | | 9/1982 | Sneider | |
| 4,838,457 | A | | 6/1989 | Swahl | |
| 4,865,224 | A | | 12/1989 | Streck | |
| 5,156,300 | A | | 10/1992 | Spahni | |
| 5,547,302 | A | | 8/1996 | Dornbusch | |
| 6,083,450 | A | | 4/2000 | Safian | |

(Continued)

FOREIGN PATENT DOCUMENTS

EP 0406134 A1 * 1/1991 ..... B65D 1/0292

*Primary Examiner* — Nicholas J Weiss

(57) ABSTRACT

A dispenser for dispensing a fluent product by twisting a flexible bag which contains the fluent product. The bag ends are connected to a container composed of a lower hollow cylinder which fits into an upper hollow cylinder. The two parts have a mutual axis which enable twisting the bag by rotating one part with respect to the other. The lower part has elastic fins on its outer cylindrical surface and the upper part has ramp shaped grooves all along its inner cylindrical surface. The fins which fit the grooves implement a rotational ratchet mechanism with capability for vertical displacement which also allows for linear bag contraction during twisting. The ratchet mechanism enables accurate control of outflow and also keeps the bag in the last twisted pose it arrives to. The bag is connected to two container parts by two butterfly nuts which enable easy manual bag replacement.

8 Claims, 8 Drawing Sheets

(56) References Cited

U.S. PATENT DOCUMENTS

| | | | | |
|---|---|---|---|---|
| 6,129,472 | A | 10/2000 | Thayer | |
| 6,238,201 | B1 | 5/2001 | Safian | |
| 6,283,339 | B1 | 9/2001 | Morrow | |
| 6,365,202 | B1 | 2/2002 | Ida | |
| 6,942,127 | B2 | 9/2005 | Raats | |
| 6,948,636 | B1 | 9/2005 | Fischer | |
| 6,988,496 | B1 | 1/2006 | Eicher | |
| 7,178,692 | B2 * | 2/2007 | Ophardt | 222/104 |
| 2005/0269359 | A1 | 8/2005 | Raats | |
| 2005/0238765 | A1 | 10/2005 | Weaver | |
| 2006/0163287 | A1 | 7/2006 | Boumnso | |
| 2007/0045339 | A1 | 1/2007 | Manion | |
| 2007/0262093 | A1 | 11/2007 | Safian | |

* cited by examiner

TWIST BASED DISPENSER

CROSS-REFERENCE TO RELATED APPLICATIONS

This application claims the benefit of a provisional patent application: Ser. No. 61/825,114 filed on May 20, 2013

FEDERALLY SPONSORED RESEARCH

Not Applicable

SEQUENCE LISTING OR PROGRAM

Not Applicable

BACKGROUND OF THE INVENTION

Field of the Invention

The invention is in the area of dispensers which employ twisting of flexible bags for dispensing fluent products stored in such bags. Fluent products include food products such mustard or ketchup or non edible products such as glue or wax.

Description of Related Art

The search for dispenser inventions which employ twisting a bag or a container yielded several applications and patents. But all of them were entirely dissimilar to our invention. Application number US 20120175337 by Gill which is entitled "Hot fill Container with Vertical Twist" describes a construction of a container with helical grooves which accommodate expansion in hot fill packaging process and has nothing to do with dispensing by twisting flexible bags.

Another invention: application number US 20070056969 by Wang pertains to a twisting collapsible container structure composed of tandem compartments supported by rigid sticks connected by swivel joints which collapse by structure twisting.

U.S. Pat. No. 6,129,472 by Thayer describes a twist dispenser which has a plurality of product compartments each with a piston which is moved by twisting a screw. U.S. Pat. No. 5,547,302 by Dornbusch describes a twist up dispenser which pushes the product by a piston installed on a twisting screw mechanism. Many other inventions use similar piston-screw method for dispensing products. U.S. Pat. No. 4,351,336 by Sneider describes a syringe for dispensing fluids which has a tubular side wall formed by a plurality of spiral ribs for twisting and collapsing while dispensing the stored fluid. The spiral ribs have flat outer surfaces separated by V-shaped grooves which allow expansion and contraction. This invention is different from our invention in several important aspects. These ribs can contract or expand only in radial direction and since they are rigid their maximal contraction is limited to a circle with a perimeter equal to their aggregate widths. This means that Sneider's dispenser cannot be entirely emptied in full contraction.

Currently, dispensers for fluent (flow-able) products such as ketchup, mustard, mayonnaise, honey, teeth paste or liquid glue are made from glass or plastic bottles. These bottles must be shaken or squeezed in order to dispense their contents. The problem with these methods of dispensing is that it is inconvenient and large portions of the contents sticks to the inner walls of the dispenser and cannot be extracted by shaking or squeezing. Partial solutions to this problem have been proposed by several patents as follows.

U.S. Pat. No. 6,083,450 by Safian, U.S. Pat. No. 6,238,201 by Safian, U.S. Pat. No. 6,988,496 by Eicher, U.S. Pat. No. 6,942,127 by Raats, U.S. Pat. No. 6,948,636 by Fischer, Ida (U.S. Pat. No. 6,365,202), Streck (U.S. Pat. No. 4,865,224), Swahl (U.S. Pat. No. 4,838,457) and in application Numbers: 20070262093 by Safian, 20070045339 by Manion, 20060163287 by Boumso, 20050269359 by Raats, 20050238765 by Weaver, and 20040062840 by Jamison disclose various multilayer containers that include an outer shell (container in our terminology) and a flexible liner (bag in our terminology) for holding fluent product to be dispensed. The product is dispensed from the bag by applying air pressure on the bag by different means. The air pressure on the walls of the bag forces the product out from the bag's opening. As product is dispensed from the dispenser, the inner bag pulls away from the outer shell and collapses. In application 20070262093 by Safian and others an atmospheric vent is disposed in the bottom wall of the shell for venting the volume between the bag and the shell to atmosphere so that the outer shell retains its geometry or configuration while the bag (inner liner) collapses as product is dispensed.

All these patents offer only a partial solution to the problem of complete dispensation of the entire volume of fluent product stored in the bag. Even though the fluent product is prevented from sticking to the container wall by holding it inside the bag, it is impossible to empty the bag entirely because of two reasons: Firstly, the fluent product flows outside the bag's opening when air pressure is exerted on the bag but the prior art did not propose any means for blocking inwards flow (reverse flow) when the air pressure is released. This results in reverse flow of air and product into the bag each time air pressure is released and it is impossible to empty the bag efficiently.

Secondly, in our experiments, we found that after applying air pressure on the bag that contains the fluent product and dispensing part of its contents, the bag tends to collapse prematurely at about its midpoint. This compartmentation happens because the external air pressure applied on the bag causes two opposite bag's walls to adhere to one another blocking the passage. This premature collapse divides the bag into two (or more) isolated compartments. Applying more pressure only empties the compartment adjacent to the bag's opening while the compartment further from the opening still remains blocked and full of fluent product that it is impossible to dispense by any additional pressure. The reason is that the further compartment remains isolated from the bag's opening by the collapsed section of the bag's walls. More pressure only adheres the collapsed walls more strongly.

To summarize, in the prior art mentioned above, there is no solutions offered for the problems of preventing reverse flow of air and product when the air pressure on the bag is released, and preventing the phenomenon of isolated compartments in the bags. Spahni et al. (U.S. Pat. No. 5,156,300), Szczepanski (U.S. Pat. No. 4,020,978), Baily (U.S. Pat. No. 4,159,790) offer a solution to these problems by adding a unidirectional outflow valve at the dispenser outlet which prevents air from entering the bag via its outlet opening and also add a porous conduit inside the bag which prevents bag's compartmentation.

BRIEF SUMMARY OF THE INVENTION

The present invention pertains to a dispenser for dispensing fluent products by twisting a flexible bag which contains the fluent product. Forcing outflow of the fluent product is based on reducing the bag's volume by twisting the bag. The twisting method is quite effective because as it decreases the bag's volume it exerts high pressure on the fluent material inside the bag forcing its outflow. This enables easy dispensing of even fluent materials with high viscosity such as toothpaste or wax. The bag ends are connected to two parts of a container composed of two concentric hollow cylindrical parts where the lower part has a cylindrical outer surface which fits into a cylindrical inner surface of the upper part. The inner cylindrical surface and the outer cylindrical surface are concentric and have a mutual longitudinal axis of rotation. Bag twisting is enabled by rotating the upper part with respect to the lower part. Elastic fins which protrude diagonally from the outer cylindrical surface of the lower part, can slide along fitting ramp shaped grooves which are manufactured on the inner cylindrical surface of the upper part. This structure implements a rotational ratchet mechanism which can travel along the ramp shaped grooves while still functioning as a rotational ratchet. Such a rotational ratchet mechanism allows at any linear displacement only a unidirectional rotation around the cylinders' mutual longitudinal axis of one cylindrical part with respect to the other cylindrical part. To function as a rotational ratchet mechanism at any linear displacement, the set of ramp shaped grooves extend along the entire cylindrical inner surface of the upper part wall in the direction parallel to the mutual longitudinal axis, while the set of elastic diagonal fins extend along just a portion of the cylindrical outer surface of the lower part wall in the direction parallel to the mutual longitudinal axis. The rotational ratchet mechanism allows for linear motion in the direction parallel to the mutual longitudinal axis of one cylinder with respect to the other cylinder. This relative motion of the cylinders, enables bag contraction during twisting. The rotational ratchet mechanism enables accurate control of outflow and also keeps the bag in the last twisted pose it arrives to when the user stops twisting. The dispenser's twisting mechanism has a simple structure comprising of just two cylindrical shells plus a bag and two butterfly nuts and does not require any airtight construction. Such a structure is relatively easier and cheaper to manufacture by plastic molding. Also, twisting the bag does not cause any bag's compartmentation as happens often in other methods of bags squeezing. By controlling the angular rotation of the traveling rotational ratchet mechanism, which controls the amount of the twisting, the user can accurately control the amount of fluent material dispensed. Unlike dispensers with solid containers, the twisting principle enables the user to dispense the fluent material until the last drop. The rotational ratchet mechanism is a mechanism capable of linear motion while functioning also as a rotational ratchet. The rotational ratchet mechanism allows vertical movement of the upper part relative to the lower part caused by the collapsing bag due to twisting. The rotational ratchet mechanism which keeps the bag at the last twisted position when not in use, preserves the bag's volume and does not allow any outside air to enter the bag. This ensures that the bag contains all the time only fluent material. This feature is important for fluent materials such as glue which deteriorate or dry up when they are in contact with air. The bag's upper end is connected to an upper member comprising an upper polygonal section which fits into an upper polygonal recess in the upper part. Similarly, the bag's lower end is connected to a lower member comprising a lower polygonal section which fits into a lower polygonal recess in the lower part. The upper polygonal member has a threaded nozzle screw which is connected also to the opening in the bag and serves as a nozzle outlet. The upper polygonal member can be fastened to the upper part by screwing and fastening an upper butterfly nut. The upper polygonal section when fitted into the upper polygonal recess prevents rotation of the upper end of the bag with respect to the upper part when the bag is being twisted. The lower polygonal section can be fastened to the lower part by screwing and fastening a lower butterfly nut. The lower polygonal section when fitted into the lower polygonal recess prevents rotation of the lower end of the bag with respect to the lower part when the bag is being twisted. The two cylindrical parts which house the bag, can be opened by unscrewing the two butterfly nuts. This enables easy manual bag replacement when the bag is emptied without needing to buy a new dispenser. Recycling the main parts of the dispenser reduces waste and cost significantly.

BRIEF DESCRIPTION OF THE DRAWINGS

FIG. 1 describes by isometric 3D drawing, the inner part of the twist dispenser which includes the flexible bag 21A at the initial state before twisting when it is full of fluent product to be dispensed.

FIG. 2 illustrates by 3D isometric drawing the bag of the dispenser at a partially twisted position when only part of the fluent product which was stored in the bag was dispensed.

FIG. 3 describes by 3D isometric drawing the bag of the dispenser at completely twisted position after the entire fluent product which was stored in the bag was already dispensed.

FIG. 4 describes in isometric 3D drawing, the upper part 24A of the dispenser's container.

FIGS. 6 and 7 describe in more detail two projections of the upper part 24A displaying cross sections of the upper part 24A.

FIG. 5 describes in isometric 3D drawing, the lower part 25A of the dispenser's container.

FIGS. 8 and 9 describe in more detail the lower part 25A displaying cross section projections of the lower part 25A.

FIG. 10 describes a cross section of the fully assembled twist dispenser including the bag 21A, which is secured by nuts 22A and 23A inside the upper 24A and lower 25A parts of the dispenser's container.

DETAILED DESCRIPTION OF THE DRAWINGS

Figure 10:
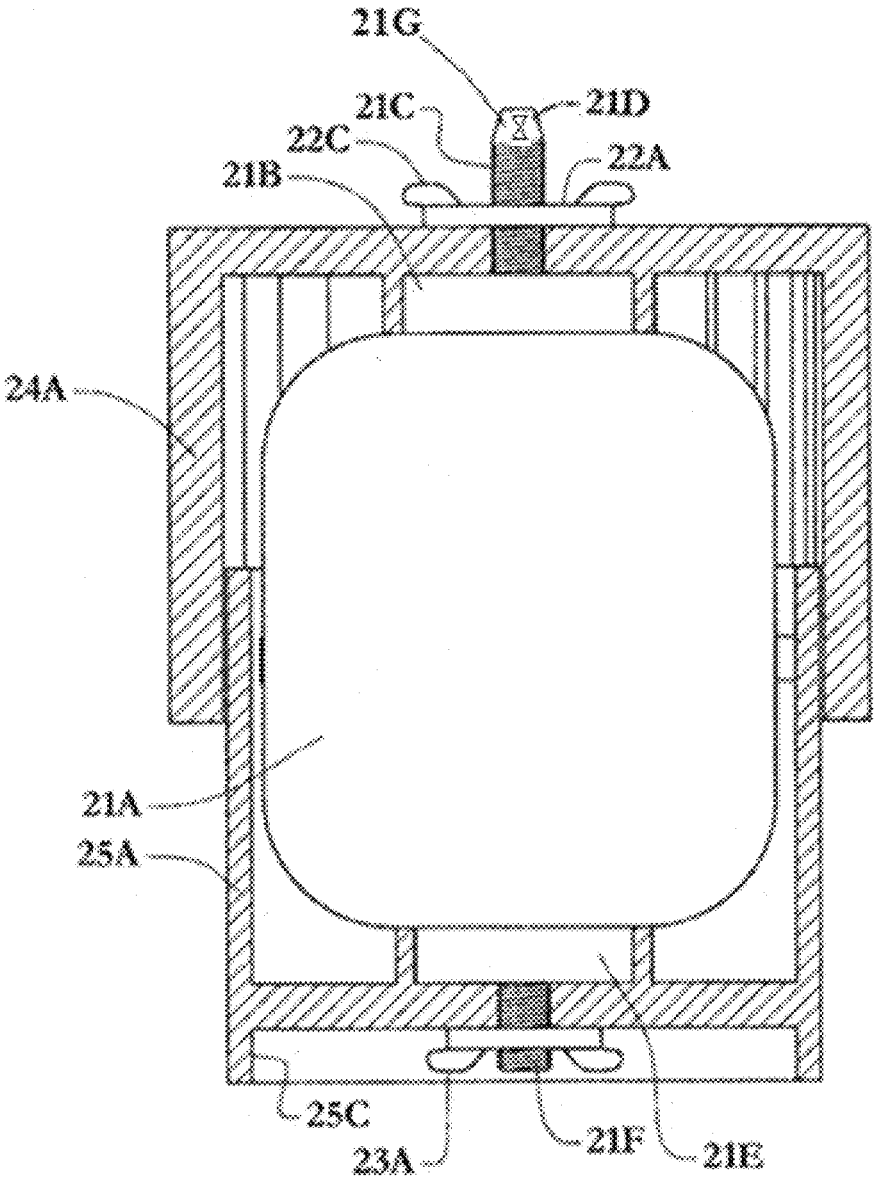

As briefly described in previous section, the dispenser is composed of 3 major parts. As illustrated in FIG. 10, the three major parts of the dispenser are the bag 21A which is secured inside the upper part 24A and the lower part 25A. The upper part and the lower part have a shape of cylindrical shells. They house the bag 21A and also create a sliding rotational ratchet mechanism with capability for linear displacement which allows to rotate the lower part with respect to the upper part only in one direction and at the same time also enables a vertical linear displacement motion in direction parallel to the cylinders' mutual axis which modifies the height of the container. The full bag 21A, which is described by FIG. 1 by isometric 3D drawing at its initial state before twisting, is fastened to the upper part 24A by a butterfly nut 22A which is screwed on a tubular screw threading 21C of the nozzle 21D. The upper end of the bag 21A is connected to an upper polygonal member 21B with a polygonal section, which fits into an upper recess 24C in the upper part 24A. The member 21B when the polygonal section is fitted into the polygonal recess 24C it prevents rotation of the upper end of the bag 21A with respect to the upper part 24A. The lower end of the bag 21A is also fastened to the lower part 25A by a butterfly nut 23A which is installed on a screw 21F. The butterfly nuts 22A and 23A which are screwed to the tubular screw—nozzle 21D and to the screw 21F respectively are butterfly nuts which enable easy manual replacement of the bag.

Figure 1:
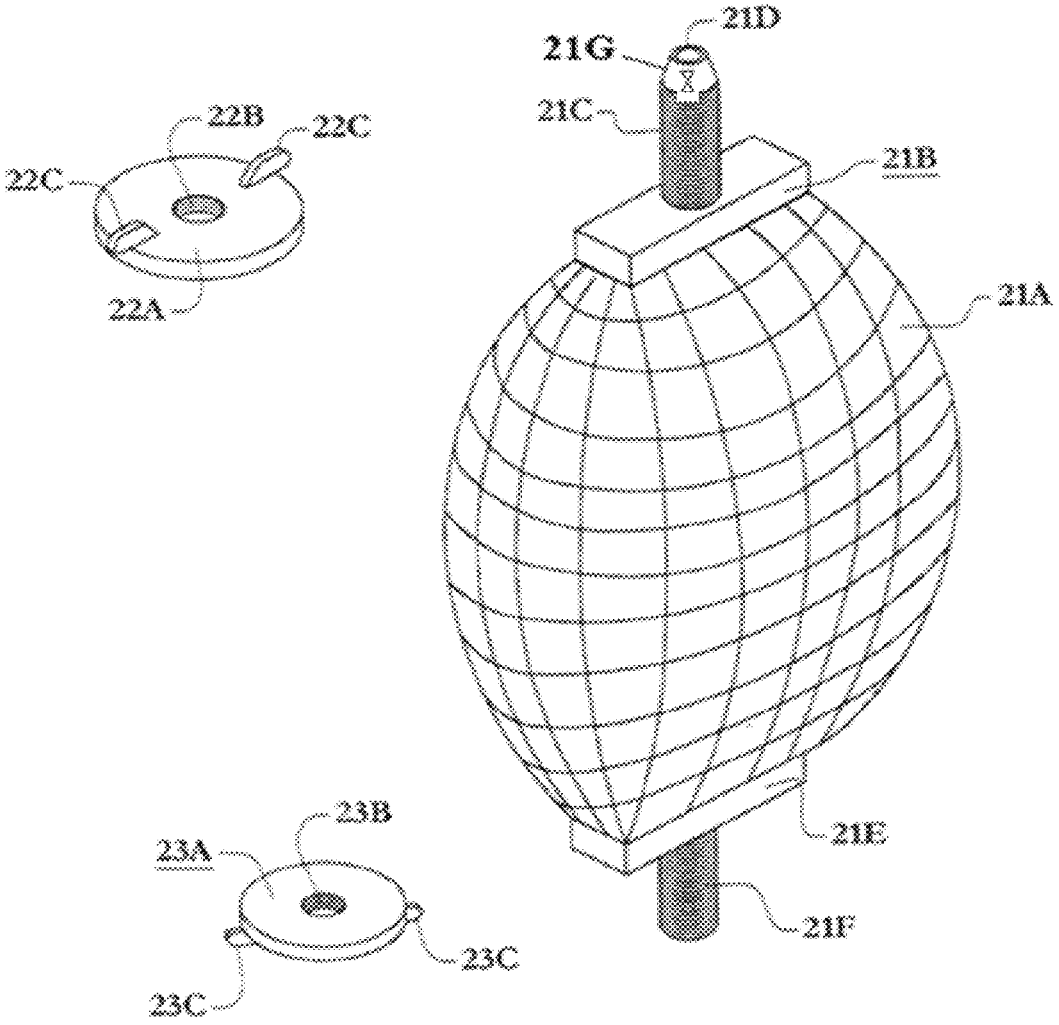
FIGS. 1, 2, 3, 4, 5, 6, 7, 8, 9 and 10 describe an embodiment of the twist dispenser.
Figure 6:
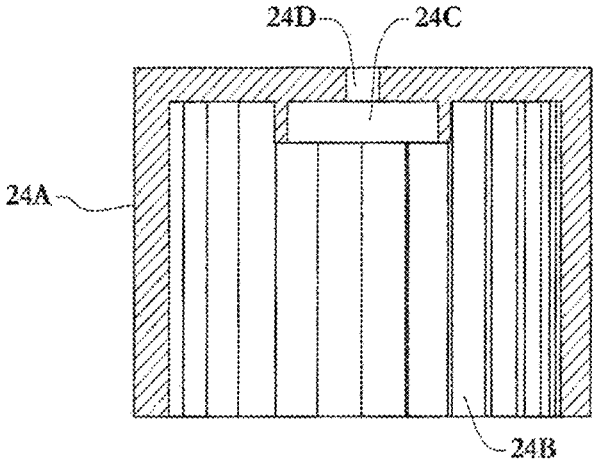
Figure 7:
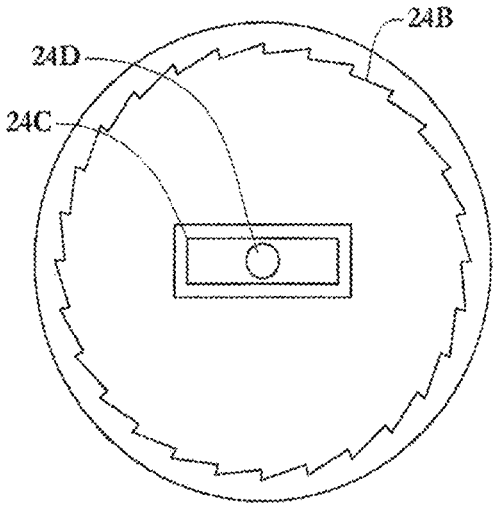

As illustrated in FIG. 1, the inner part of the twist dispenser includes the bag 21A, which is filled with fluent product to be dispensed. The bag 21A is attached to the upper member 21B which has an outlet nozzle 21D which channels the outflow of the fluent product from the bag's opening. As depicted in FIG. 10, the upper member 21B is also used to prevent the rotation of the bag 21A with respect to the upper part of the container 24A. Upper member 21B also is fastened to the upper part 24A using the nozzle's screw threading 21C and the butterfly nut 22A. The upper member 21B which has a polygonal section fits into the polygonal recess 24C attached to the ceiling of the upper part 24A. Fitting the upper member 21B into the polygonal recess 24C (which is illustrated in FIGS. 6 and 7) fixes the orientation of the upper member 21B with respect to the upper part of the container 24A and secures it with respect to any independent motion including rotation.

Figure 8:
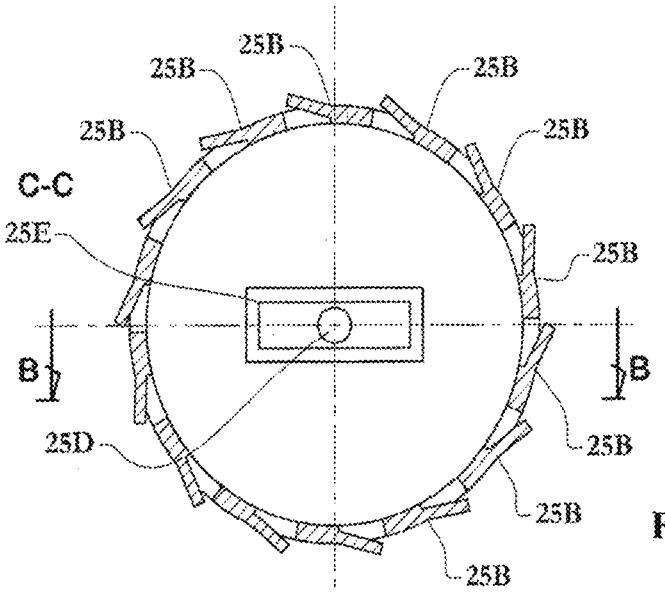
Figure 9:
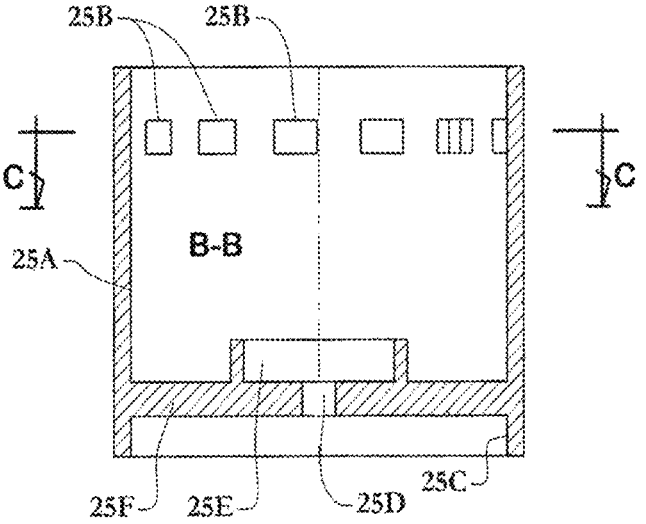

As described in FIG. 10, the bottom of the bag 21A is attached to a lower member 21E which is used to anchor the lower end of the bag 21A to the lower recess 25E in the lower part of the container 25A and to prevent rotation of the bottom of the bag 21A with respect to the lower part 25A. The lower member is also fastened to the lower part 25A using the screw 21F and the butterfly nut 23A. As illustrated in FIGS. 8,9 and 10, the lower member 21E which has a polygonal section which fits into the lower polygonal recess 25E attached to the floor 25F of the lower part 25A. This fastens the lower member 21E to the lower part of the container 25A and secures it with respect to any independent motion including rotation. The lower polygonal recess 25E is illustrated in FIGS. 8 and 9.

Figure 4:
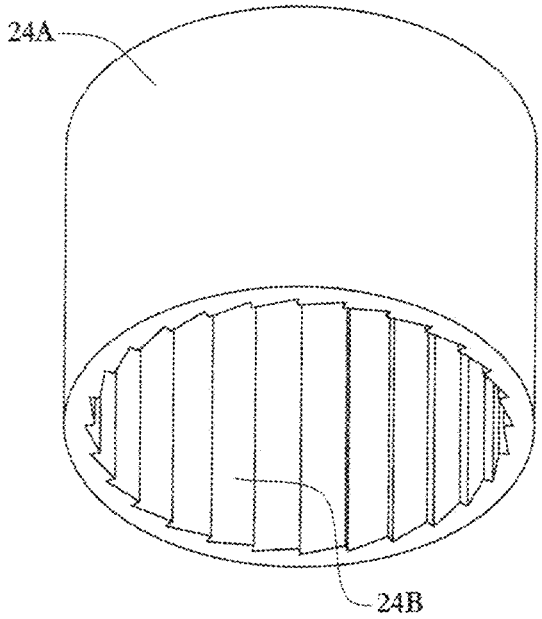
Figure 5:
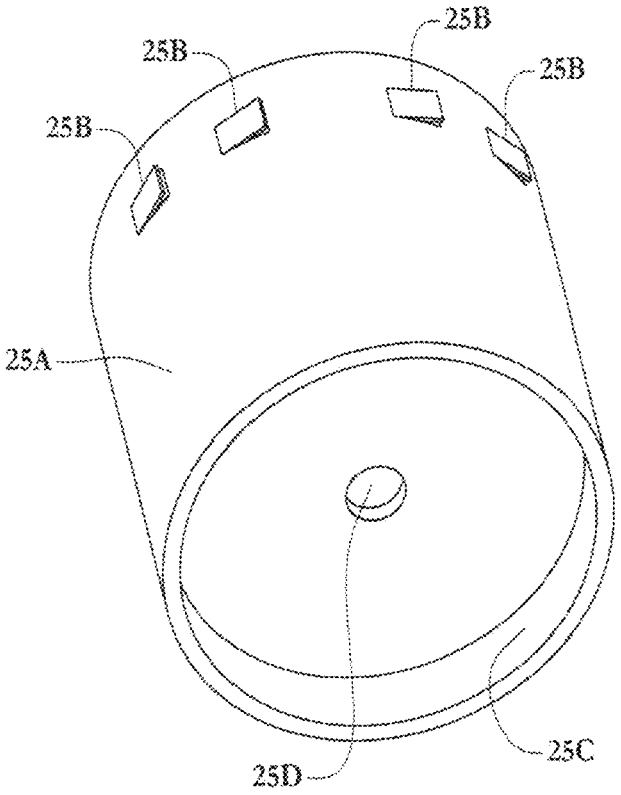

FIGS. 5, 8 and 9 illustrate the lower part of the container of the twist dispenser. The lower part has a cylindrical outer surface with several flexible and resilient fins 25B which protrude diagonally from the cylindrical outer surface of the lower part 25A. When the dispenser is assembled, the lower part 25A fits inside the upper part of the container 24A. The inner cylindrical surface of the upper part 24A and the outer cylindrical surface of the lower part 25A have a mutual longitudinal axis of rotation. As illustrated in FIGS. 4, 6 and 7, the inner side of the upper part 24A has a shape of a hollow cylinder which its inner cylindrical surface is covered all around it with a sequence of small-identical ramp shaped grooves 24B with the same shapes and direction. The ramp shaped grooves 24B are radial and their faces are parallel to the mutual longitudinal axis of the inner cylindrical surface of the upper part 24A. As a result, the ramp shaped grooves 24B have the same ramp shaped cross sections which are engraved from the bottom to the top of the inner cylindrical surface of the hollow cylinder of the upper part 24A. As can be observed from FIGS. 4, 5, 6, 9 and 10, the set of ramp shaped grooves 24B extend along the entire cylindrical inner surface of the upper part wall 24A in a direction parallel to the mutual longitudinal axis of the upper and lower parts, while the set of elastic diagonal fins 25B extend along just a longitudinal portion of the cylindrical outer surface of the lower part wall 25A in a direction parallel to the longitudinal mutual axis. This enables the fins to travel along the grooves and preserves the rotational ratchet operation at any linear displacement along the grooves. The linear displacement of the rotational ratchet allows for bag contraction during twisting.

When the lower part 25A is installed inside hollow cylinder of the upper part 24A, the elastic fins 25B are able to rotate around the hollow cylinder's ramp shaped grooves 24B. The diagonal structure of the elastic fins and the matching diagonal structure of the ramp shaped grooves 24B manufactured on the inner cylindrical surface in the hollow cylinder of the upper part 24A allow rotation only in one direction. Thus, the lower part of the container 25A is able to rotate only in forward direction with respect to the upper part and is blocked in the reverse direction. Thus, the structures of the lower and upper parts create a rotational ratchet operation. The user can rotate the lower part with respect to the upper part only in forward direction. Since the ramp shaped grooves 24B are parallel to the mutual longitudinal axis of the cylindrical inner surface of the upper part 24A and the outer cylindrical surface of the lower part 25A, the lower part of the container 25A can move up or down along the mutual axis and still act also as a rotational ratchet at different axial displacements. This creates a rotational ratchet mechanism with capability for linear displacements.

As illustrated in FIG. 10, the lower member 21E which is attached to the bottom of the bag 21A is fitted into the lower recess 25E in the lower part and is fastened to the lower part of the container 25A by the lower screw 21F and the lower butterfly nut 23A. The upper member 21B which is attached to the top of the bag 21A fits into the upper recess 24C and is fastened to the upper part 24A by an upper butterfly nut 22A which is screwed on the tubular screw 21C. The bag is being twisted when the user rotates the lower part 25A with respect to the upper part 24A. Gradually twisting the bag 21A lowers its volume and this forces outflow of the fluent product stored in the bag 21A through the bag's opening which is fluidly attached to the nozzle 21D. There is an option, which is not claimed in this patent to equip nozzle 21D with a valve with open and shut positions, which controls the outflow of the fluent product through the nozzle 21D.

Figure 2:
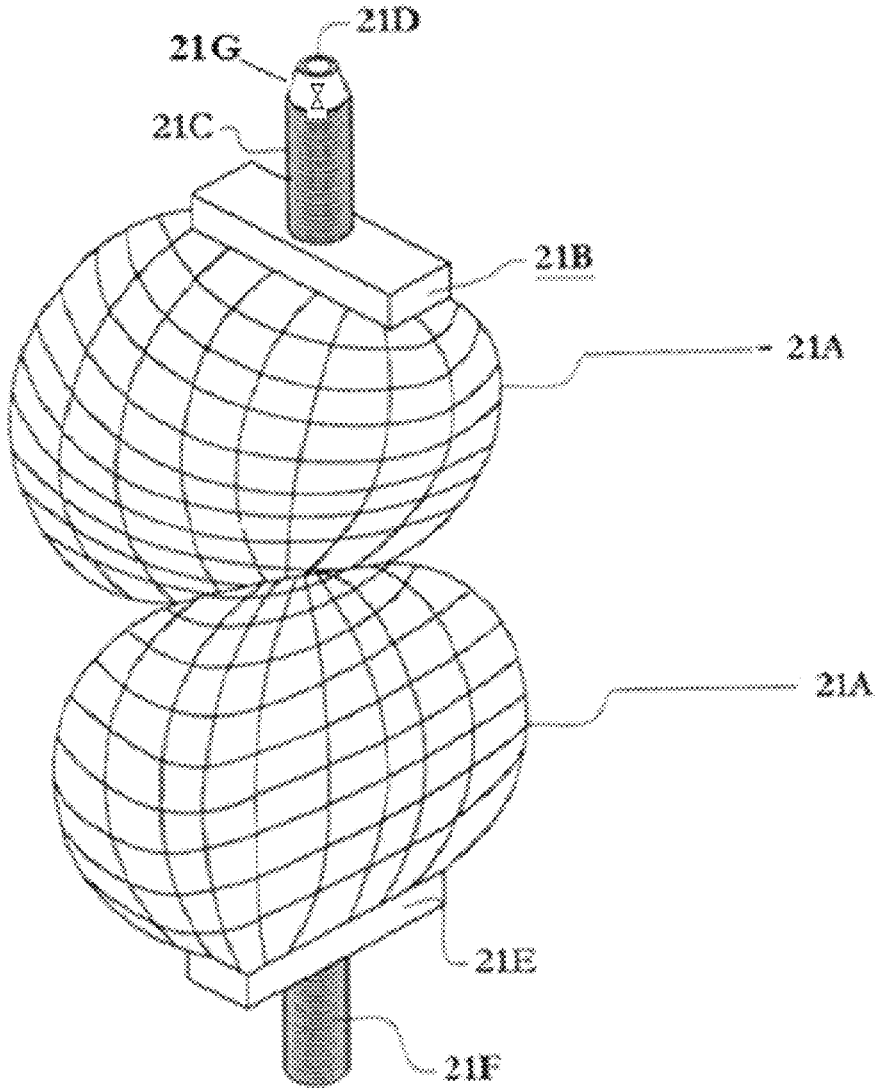

FIG. 2 describes the bag 21A of the twist dispenser in an intermediate twisted stage. As can be observed from FIG. 2, when the bag 21A is twisted, its volume decreases and the gradual reduction of volume while twisting, forces outflow of the fluent product stored in the bag 21A via the outlet nozzle 21D. Since the elastic fins 25B which are sliding on the surface of the ramp shaped grooves 24B create a rotational ratchet operation which does not allow the rotated upper member 21B to rotate backwards, the twisted bag 21A remains twisted in the same pose until the user twists it more when the user wants to extract more fluent product from the bag. The rotational ratchet mechanism with capability for linear displacement was introduced into the dispenser because resilient bags are elastic and their natural tendency once twisted is to return to their original shape. If there was no ratchet present, the bag would rotate backwards once twisted and released. While rotating backwards, the volume of the bag increases and it sucks outside air to fill its increased volume. In such a case, the user would need to twist the bag all the way forward in order to extract all the sucked air before getting any new outflow of fluent product. Also, letting outside air into the bag might spoil certain kinds of fluent products such as glue or paint. So, the rotational ratchet is essential for efficient dispensing.

Figure 3:
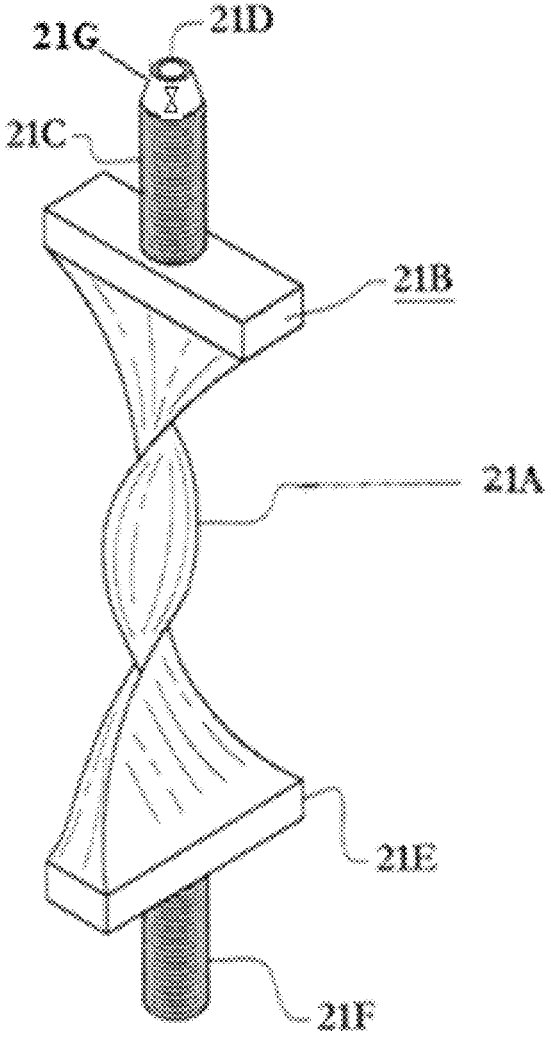

Since the ramp shaped grooves 24B in the inner cylindrical surface of the upper part 24A have identical cross section shapes from the bottom to the top of 24A as illustrated in FIGS. 4,6 and 7, the user gets the same rotational ratchet operation at any vertical displacement between the upper and the lower parts of the container. When the bag 21A is being twisted, it becomes also shorter as shown in FIG. 3. It means that the distance between the upper member 21B and the lower member 21E becomes shorter. Since the upper member 21B is secured and fastened to the upper part 24A and the lower member 21E is secured and fastened to the lower part 25A when the bag is getting shorter it drags and creates a linear vertical motion of the lower part 25A of the container with respect to the upper part 24A. But since the ramp shaped grooves have the same cross sections from bottom to top of the upper part, the ratchet operation remains active at any vertical displacement between the upper and the lower parts.

As depicted in FIG. 10, the bag 21A is fastened to the upper part of the container 24A by a butterfly nut 22A and to the lower part 25A by a butterfly nut 23A. Hence, the user can easily replace an empty bag by manually releasing the nuts and fastening a new, full bag to the same container. This feature reduces the waste since the container can be used multiple times replacing only the emptied bags.

The invention claimed is:

1. A dispenser for dispensing a fluent product; the dispenser comprising:

a container comprising;

an upper part, having a side wall with a cylindrical inner surface;

a ceiling connected to the side wall at an upper end of the upper part; and a ceiling opening through the ceiling; and a lower part, having a side wall with a cylindrical outer surface;

a floor connected to the side wall at a lower end of the lower part; and a floor opening through the floor;

the cylindrical outer surface is configured to fit into the cylindrical inner surface; the cylindrical inner surface and the cylindrical outer surface having a mutual longitudinal axis; and a bag configured to fit into the container and filled with the fluent product to be dispensed, the bag comprising;

a bag upper end having a bag opening;

a bag lower end;

a skin between the bag upper end and the bag lower end made of a flexible and resilient material;

an upper member coupled to the bag upper end having a nozzle with a threaded nozzle screw extending upwards from the upper member; wherein the bag opening is connected to the nozzle; wherein the threaded nozzle screw is configured to fit into the ceiling opening; and a lower member coupled to the bag lower end having a threaded screw extending downwards away from the lower member; wherein the threaded screw is configured to fit into the floor opening;

the upper member coupled to the ceiling, and the lower member coupled to the floor;

the container further comprising a rotational ratchet mechanism having a plurality of elastic fins protruding diagonally outwards from the cylindrical outer surface, and a plurality of ramp shaped grooves extending along an entirety of the cylindrical inner surface in a direction parallel to the mutual longitudinal axis while the plurality of elastic fins extending along a longitudinal portion of the cylindrical outer surface; the plurality of ramp shaped grooves are configured to receive the plurality of elastic fins when the upper part and the lower part of the container are fit together;

wherein the rotational ratchet mechanism only allows a unidirectional rotation of the upper part relative to the lower part of the container, wherein the rotational ratchet mechanism also allows for a vertical displacement of the upper part relative to the lower part of the container;

wherein, rotation of the upper part of the container relative to the lower part of the container, which in turn twists and collapses the bag internal to the container, causes the floor of the lower part to move closer to the ceiling of the upper part, while dispensing the fluent material via the nozzle.

2. The dispenser of claim 1, wherein the ceiling further comprising an upper polygonal recess and the upper member further comprising an upper polygonal section which is configured to fit into the upper polygonal recess;

wherein, the upper polygonal section is configured to prevent rotation of the upper member relative to the upper part when the upper polygonal section is installed in the upper polygonal recess;

wherein, the floor further comprising a lower polygonal recess and the lower member further comprising a lower polygonal section which is configured to fit into the lower polygonal recess;

wherein, the lower polygonal section is configured to prevent rotation of the lower member relative to the lower part when the lower polygonal section is installed in the lower polygonal recess.

3. The dispenser of claim 2;

wherein, the upper member is fastened to the upper part, when the upper polygonal section is installed into the upper polygonal recess and an upper butterfly nut is fastened on the threaded nozzle screw;

the lower member is fastened to the lower part, when the lower polygonal section is installed into the lower polygonal recess and a lower butterfly nut is fastened on the threaded screw.

4. A dispenser for dispensing a fluent product; the dispenser comprising:

a container comprising;

an upper part, having a side wall with a cylindrical inner surface;

a ceiling connected to the side wall at an upper end of the upper part; and a ceiling opening through the ceiling; and a lower part, having a side wall with a cylindrical outer surface;

a floor connected to the side wall at a lower end of the lower part; and a floor opening through the floor;

the cylindrical outer surface is configured to fit into the cylindrical inner surface; the cylindrical inner surface and the cylindrical outer surface having a mutual longitudinal axis; and a bag configured to fit into the container and filled with the fluent product to be dispensed, the bag comprising;

a bag upper end having a bag opening;

a bag lower end;

a skin between the bag upper end and the bag lower end made of a flexible and resilient material;

an upper member coupled to the bag upper end having a nozzle extending upwards from the upper member; wherein the bag opening is connected to the nozzle; wherein the nozzle is configured to fit into the ceiling opening; and a lower member coupled to the bag lower end;

the upper member coupled to the ceiling, and the lower member coupled to the floor;

the container further comprising a rotational ratchet mechanism having a plurality of elastic fins protruding diagonally outwards from the cylindrical outer surface, and a plurality of ramp shaped grooves extending along an entirety of the cylindrical inner surface in a direction parallel to the mutual longitudinal axis while the plurality of elastic fins extending along a longitudinal portion of the cylindrical outer surface; the plurality of ramp shaped grooves are configured to receive the plurality of elastic fins when the upper part and the lower part of the container are fit together;

wherein the rotational ratchet mechanism only allows a unidirectional rotation of the upper part relative to the lower part of the container, wherein the rotational ratchet mechanism also allows for a vertical displacement of the upper part relative to the lower part of the container;

wherein, rotation of the upper part of the container relative to the lower part of the container, which in turn twists and collapses the bag internal to the container, causes the floor of the lower part to move closer to the ceiling of the upper part, while dispensing the fluent material via the nozzle.

5. The dispenser of claim 4;

wherein, the nozzle having a threaded nozzle screw extending upwards from the upper member; wherein the threaded nozzle screw is configured to fit into the ceiling opening;

the lower member having a threaded screw extending downwards from the lower member; wherein the threaded screw is configured to fit into the floor opening.

6. The dispenser of claim 5, wherein, the ceiling further comprising an upper polygonal recess and the upper member further comprising an upper polygonal section which is configured to fit into the upper polygonal recess;

wherein, the upper polygonal section is configured to prevent rotation of the upper member relative to the upper part when the upper polygonal section is installed in the upper polygonal recess;

wherein, the floor further comprising a lower polygonal recess and the lower member further comprising a lower polygonal section which is configured to fit into the lower polygonal recess;

wherein, the lower polygonal section is configured to prevent rotation of the lower member relative to the lower part when the lower polygonal section is installed in the lower polygonal recess.

7. The dispenser of claim 6;

wherein, the upper member is fastened to the upper part, when the upper polygonal section is installed into the upper polygonal recess and an upper butterfly nut is fastened on the threaded nozzle screw;

the lower member is fastened to the lower part, when the lower polygonal section is installed into the lower polygonal recess and a lower butterfly nut is fastened on the threaded screw.

8. The dispenser of claim 4, wherein, the ceiling further comprising an upper polygonal recess, and the upper member further comprising an upper polygonal section which is configured to fit into the upper polygonal recess;

wherein, the upper polygonal section is configured to prevent rotation of the upper member relative to the upper part when the upper polygonal section is installed in the upper polygonal recess;

the floor further comprising a lower polygonal recess, and the lower member further comprising a lower polygonal section which is configured to fit into the lower polygonal recess;

wherein, the lower polygonal section is configured to prevent rotation of the lower member relative to the lower part when the lower polygonal section is installed in the lower polygonal recess.

* * * * *